US011998072B2

(12) United States Patent
Patton et al.

(10) Patent No.: US 11,998,072 B2
(45) Date of Patent: Jun. 4, 2024

(54) VENTILATION AND TEMPERATURE ADJUSTMENT OPENING FOR OUTDOOR EQUIPMENT

(71) Applicant: Nemo Equipment, Inc., Dover, NH (US)

(72) Inventors: Wilson Sparberg Patton, Rye, NH (US); Hannah Selene Chabot, Waterboro, ME (US); Noah Pitchforth, Arundel, ME (US); Camon Brensinger, Stratham, NH (US)

(73) Assignee: NEMO EQUIPMENT, INC., Dover, NH (US)

( * ) Notice: Subject to any disclaimer, the term of this patent is extended or adjusted under 35 U.S.C. 154(b) by 844 days.

(21) Appl. No.: 17/075,779

(22) Filed: Oct. 21, 2020

(65) Prior Publication Data

US 2021/0085006 A1 Mar. 25, 2021

Related U.S. Application Data

(63) Continuation-in-part of application No. 16/696,141, filed on Nov. 26, 2019, now Pat. No. 10,827,789,
(Continued)

(51) Int. Cl.
*A41D 27/00* (2006.01)
*A41D 27/28* (2006.01)
(Continued)

(52) U.S. Cl.
CPC ..... *A41D 27/285* (2013.01); *A41D 31/065* (2019.02); *A47G 9/0215* (2013.01); *A47G 9/086* (2013.01)

(58) Field of Classification Search
CPC ..... A47D 27/00; A47D 27/28; A41D 27/285; A41D 31/065; A47G 9/0215; A47G 9/08; A47G 9/086; A47G 9/00
See application file for complete search history.

(56) References Cited

U.S. PATENT DOCUMENTS 3,988,791 A * 11/1976 Simon ..... A47G 9/086 5/413 R
4,843,647 A * 7/1989 Phillips, Sr. ..... A47G 9/086 2/93

(Continued)

FOREIGN PATENT DOCUMENTS

KR 1020160097373 8/2016

OTHER PUBLICATIONS

European Communication attaching Supplementary European Search Report, dated Oct. 19, 2023.
Canadian Examination Search Report dated Jan. 5, 2024.

*Primary Examiner* — Fredrick C Conley
(74) *Attorney, Agent, or Firm* — PRETI FLAHERTY BELIVEAU & PACHIOS LLP

(57) ABSTRACT

An outdoor item such as a sleeping bag, jacket, hat or blanket with one or more ventilation/temperature adjustment openings. Each ventilation/temperature adjustment opening includes, in one embodiment, a mechanism that serves to either form an opening in one or both of the outer layer, and the inner layer of the outdoor item. In another embodiment, the one or more ventilation/temperature adjustment mechanism includes an air bladder which, when inflated, serves to push aside any insulation adjacent the deflated air bladder while in both embodiments, allowing the outdoor item to vent better, thereby cooling an occupant using or wearing the outdoor item thereby offering temperature regulation.

14 Claims, 7 Drawing Sheets

Related U.S. Application Data which is a continuation-in-part of application No. 14/284,892, filed on May 22, 2014, now Pat. No. 10,512,344.

(51) Int. Cl.

| | |
|---|---|
| ***A41D 31/06*** | (2019.01) |
| ***A47G 9/02*** | (2006.01) |
| ***A47G 9/08*** | (2006.01) |

(56) References Cited

U.S. PATENT DOCUMENTS

| | | | | |
|---|---|---|---|---|
| 8,707,479 | B2 * | 4/2014 | Benninger | A47G 9/086 5/413 R |
| 9,301,556 | B2 * | 4/2016 | Koller | A41D 3/02 |
| 2014/0366239 | A1 * | 12/2014 | Biller | A41D 15/00 2/69.5 |
| 2014/0366269 | A1 | 12/2014 | Brensigner et al. | |
| 2015/0327608 | A1 * | 11/2015 | Kurtzweg | A41D 27/28 2/93 |

* cited by examiner

VENTILATION AND TEMPERATURE ADJUSTMENT OPENING FOR OUTDOOR EQUIPMENT

CROSS-REFERENCE TO RELATED APPLICATIONS

This application in a continuation-in-part of U.S. patent application Ser. No. 16/696,141 entitled VENTILATION AND TEMPERATURE ADJUSTMENT OPENING FOR OUTDOOR EQUIPMENT filed on Nov. 26, 2019, which is a continuation-in-part of U.S. patent application Ser. No. 14/284,892 entitled VENTILATION AND TEMPERATURE ADJUSTMENT OPENING FOR SLEEPING BAGS filed on May 22, 2014 which claims priority from U.S. Provisional Patent Application No. 61/806,108, titled "Outdoor Products", which was filed on Mar. 28, 2013, all of which are incorporated fully herein by reference.

TECHNICAL FIELD

The present invention relates to outdoor equipment and products and more particularly, relates to outdoor equipment used for covering and providing warmth to a user such as sleeping bags, clothing and blankets, each having adjustable ventilation/temperature control openings.

BACKGROUND INFORMATION

Sleeping bags, clothing and outdoor blankets are typically rated by their ability to handle certain temperature extremes. For example, a sleeping bag may be rated to −10° F. or −30° F. When using a sleeping bag that is rated for a cooler environment, the sleeping bag can be too warm when used in a warmer environment. The same is true of clothing and blankets for outdoor use for example. The typical solution is for a user to have multiple sleeping bags or jackets or other clothing items and blankets rated for different temperatures. This is expensive and sometimes may still leave the user with a sleeping bag that is too warm for the encountered weather when temperature conditions which may not be as cold as expected. The same problem exists in other outdoor items such as jackets, blankets and even hats.

Therefore, in order to be able to adjust to ever-changing temperatures, what is needed is outdoor equipment that offers temperature regulation through increased breathability and the ability to allow an occupant to "cool down" without requiring the occupant to fully open the outdoor equipment.

SUMMARY OF THE INVENTION

The invention features a piece of outdoor covering such as a sleeping bag, jacket, blanket, hat or the like having one or more ventilation or temperature adjustment openings. Referring to a sleeping bag for example, the sleeping bag comprises an upper region, configured for containing a head, shoulder and upper body portion of a user, a lower region configured for containing a lower body portion including feet and legs of the user, and a middle region located between the upper and lower regions. Each of the upper, lower and middle regions constructed of a top layer of material, a bottom layer of material and an insulative material disposed between the top and bottom layers.

At least one ventilation/temperature adjustment opening is disposed in one of the sleeping bag upper, middle or lower regions. In a first embodiment, the at least one ventilation/temperature adjustment opening is formed by providing an opening in the top layer of material and in the insulative material disposed beneath the opening in the top layer of material. The opening in the insulative material is defined by a first and a second inner wall of the ventilation/temperature adjustment opening, the first and second inner walls formed by an inner wall material layer, each inner wall material layer including a portion attached to the sleeping bag top layer and a portion attached to the sleeping bag bottom layer.

The at least one ventilation/temperature adjustment opening includes a fastening mechanism coupled to the sleeping bag top or outer layer of material. The fastening mechanism includes a first fastener element disposed on a first side of the ventilation/temperature adjustment opening and a second fastener element disposed on a second side of the ventilation/temperature adjustment opening. The fastening mechanism is configured for opening and closing the at least one ventilation/temperature adjustment opening.

In one embodiment, the ventilation/temperature adjustment opening is located in the middle region of the sleeping bag. The ventilation/temperature adjustment opening begins in the lower region of the sleeping bag and extends to the upper region.

In one or more embodiments, the insulative material may be selected from the group consisting of down fill, polyester fill, natural insulative material and synthetic insulative material while the fastening mechanism may be selected from the group consisting of a zipper, a plurality of hook and loop fasteners, a plurality of buttons and button holes and a plurality of snap fasteners.

The sleeping bag according to the first embodiment of the present invention may include two of the ventilation/temperature adjustment openings.

In another embodiment, the present invention features and outdoor item in the form of a covering configured to provide warmth to a user. An example of such a covering includes a jacket, blanket and/or hat for example. Much like the sleeping bag described herein, the covering is constructed of an outer layer of non-insulative material, an inner layer of non-insulative material and an insulative material layer disposed between the outer and inner layers.

The invention is not intended to be limited to a device or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention.

In a second embodiment, the invention features a covering for providing warmth to a user and including one or more temperature adjustment openings. The covering is configured to provide warmth to a user and constructed of an outer layer of non-insulative material, an inner layer of non-insulative material and an insulative material disposed between the outer and inner layers. The covering further includes a plurality of baffles coupled between the outer layer and the inner layer. The plurality of baffles are configured for forming a plurality of covering cells, wherein a first and a second of the plurality of baffles are configured for forming a single covering cell. Each of the plurality of covering cells include the insulative material disposed between the outer and inner layers and the first and second baffles.

The covering includes at least a first temperature adjustment opening forming device, disposed between a first covering cell and a second covering cell. The at least a first temperature adjustment opening forming device configured for forming at least a first temperature adjustment opening having no insulative material and disposed between the outer and inner layers and between the first and second covering cells, thus allowing body heat from proximate the inner layer of the covering to pass through the outer layer of the covering without passing through the insulative material.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1A:
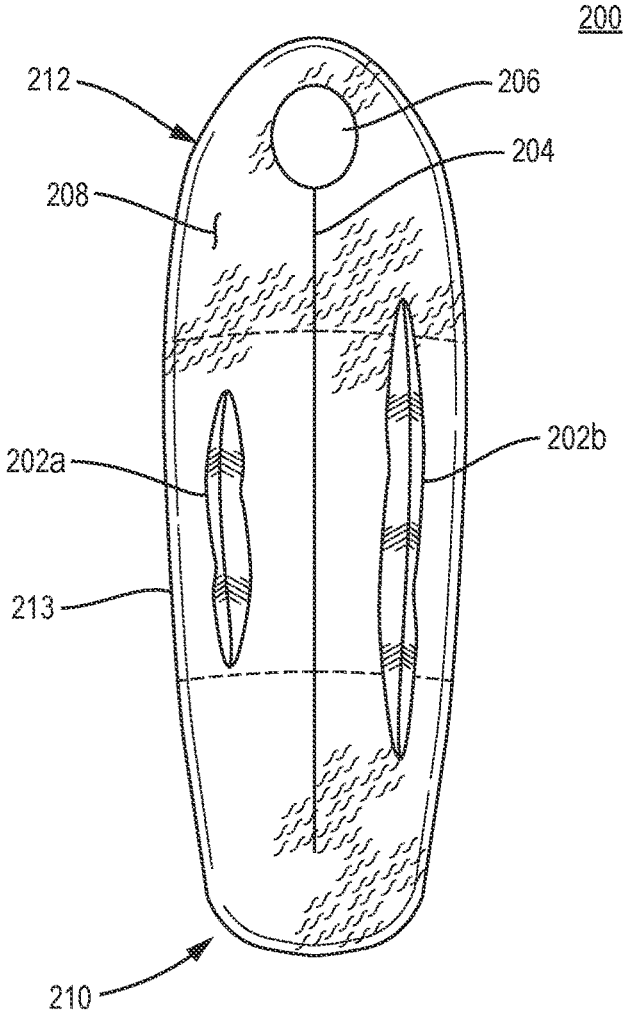
FIG. 1A is a detailed view of the location of the thermo-gills according to one embodiment of the present invention.

The present invention features one or more ventilation/temperature adjustment openings or "thermo gills" for a piece of outdoor equipment used for covering and providing warmth to a user such as a sleeping bag, jacket or blanket. In a first embodiment of the present invention, first and second thermo-gills or temperature/venting elements 202 are illustrated and described in connection with a sleeping bag 200, FIGS. 1A and 1B, although this illustrative use is not a limitation of the present invention.

In this first embodiment, the sleeping bag 200, which can be any type of sleeping bag, features a length and width, and includes two ventilation or temperature adjustment openings 202*a* and 202*b*, which extend along a length of the front or side of the sleeping bag 200. A first ventilation or temperature adjustment opening 202*a* is located on a first side of a central access opening 204 and a second ventilation or temperature adjustment opening 202*b* is located on a second side of the central access opening 204. The central access opening 204 is typically a zipper which is utilized to allow the user to enter and exit the sleeping bag 200. Once the user is inside, the zipper is pulled up proximate the head or shoulder region 206 of the user now located inside the sleeping bag as is well known in the art.

Figure 1B:
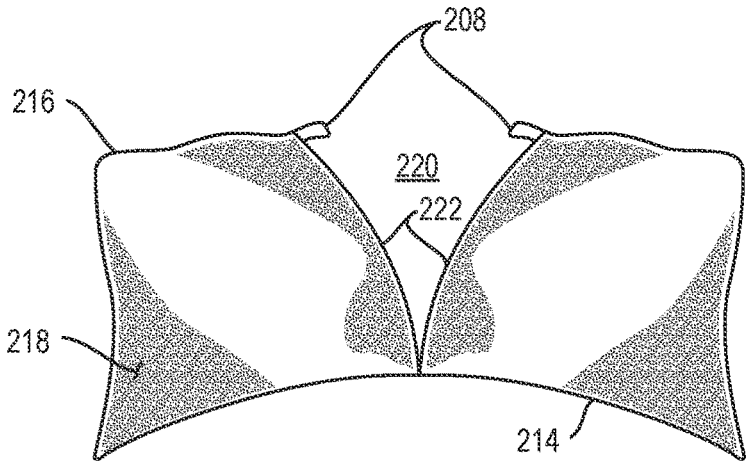
FIG. 1B is a cross-sectional view of the ventilation or temperature adjustment openings for a sleeping bag in an open position according to one embodiment of the present invention.

Each ventilation or temperature adjustment opening 202 is formed by a two part traditional zipper 208, FIG. 1B, or similar and equivalent closure or fastener mechanism sewed or otherwise adhered to a region proximate the outer layer 216 of the sleeping bag 200 such as a hook and loop closure, a plurality of buttons, and a plurality of snaps. The length of the ventilation or temperature adjustment openings 202 may vary without the departing from the scope and intent of the present invention. For example, the ventilation or temperature adjustment opening 200 may begin near the foot box portion 210 of the sleeping bag 200 and extend anywhere up to and including the shoulder region 212 of the sleeping bag 200. Alternatively, as shown in the drawing, the ventilation or temperature adjustment openings 200 may be located generally in the central or middle region 213 of the sleeping bag which would be in the area of the midsection of the user (not shown) when located inside the sleeping bag.

As shown in FIG. 1B, the sleeping bag consists of an inner material 214 such as 20 denier durable, water repellent nylon which is designed to rest closest to the user; and an outer layer 216 such as 15 denier ripstop, polyurethane coated, water proof and breathable nylon exposed to the air and elements. In one embodiment, the inner material 214 may be different in different parts of the sleeping bag. For example, the foot box portion or lower region 210 of the sleeping bag may have a different inner material such as 33 to 44 denier ripstop nylon that is durable water repellent treated and having a Cire finish that increases shininess.

Between the inner layer 214 and the outer layer 216 is the insulative material 218 which may include but is not limited to down fill; polyester fill or any other type of natural or synthetic insulative material which may be utilized in the construction of a sleeping bag 200 and which gives the sleeping bag its warmth.

When the zipper or other fastening mechanism 208 of the ventilation or temperature adjustment opening 202 is opened, a crevice or generally "V" shaped opening 220 is formed in the outer layer 216 and the insulative material 218, allowing the sleeping bag to breathe better, thereby cooling an occupant of the sleeping bag and offering temperature regulation. The inner walls 222 of the opening 220 may be formed from the same material as the outer layer 216; the same material as the inner layer 214; or a completely different material, all as selected by the manufacturer of the sleeping bag. The inner layer 214 remains intact to prevent the sleeping bag 200 from dividing into two (2) sections and/or to prevent insects and the like from entering the sleeping bag, garment, blanket or other covering provided with one or more ventilation openings.

The amount of ventilation provided to the user may be adjusted and selected by the user by simply opening or closing more or less of the zipper or other fastener 208, which adjusts the length of the ventilation or temperature adjustment openings 202. In this way, a very insulative sleeping bag designed for cold or very cold weather may be utilized in moderately cold weather without causing the user to overheat in the sleeping bag by simply adjusting the ventilation or temperature control openings 202, thereby eliminating the need for a user to try to accurately predict the temperature where he or she is going and predict which sleeping bag should be used and instead, simply regulate the warmth afforded by the sleeping bag utilizing the temperature or ventilation openings 202 of the present invention to instead regulate the temperature inside the bag. The same holds true for other outdoor coverings such as jackets, blankets and potentially even hats and the like.

Figure 2:
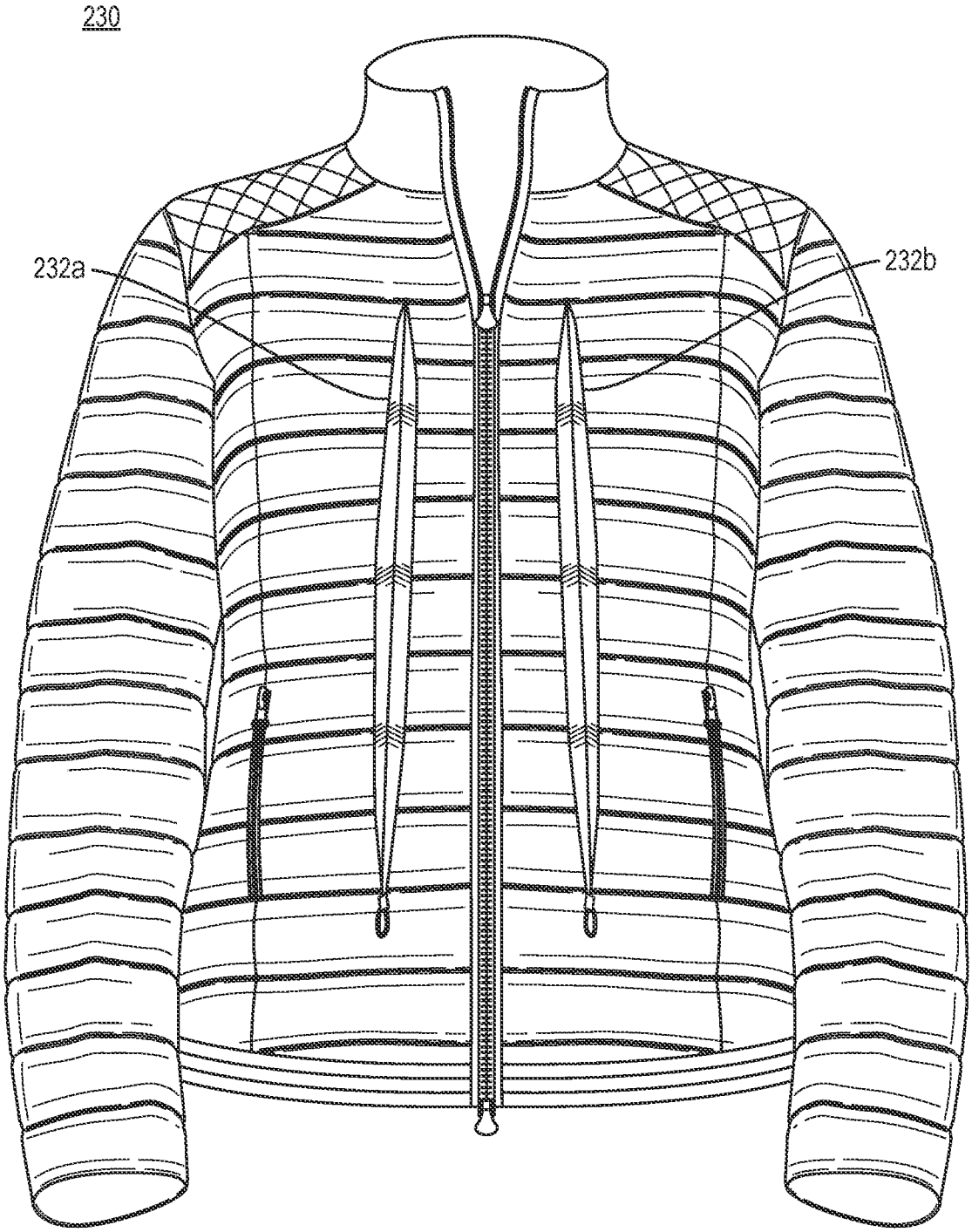
FIG. 2 is a front prospective view of the ventilation or temperature adjustment openings for outdoor equipment shown in an open position in an outdoor jacket according to one feature of the present invention.
Figure 3:
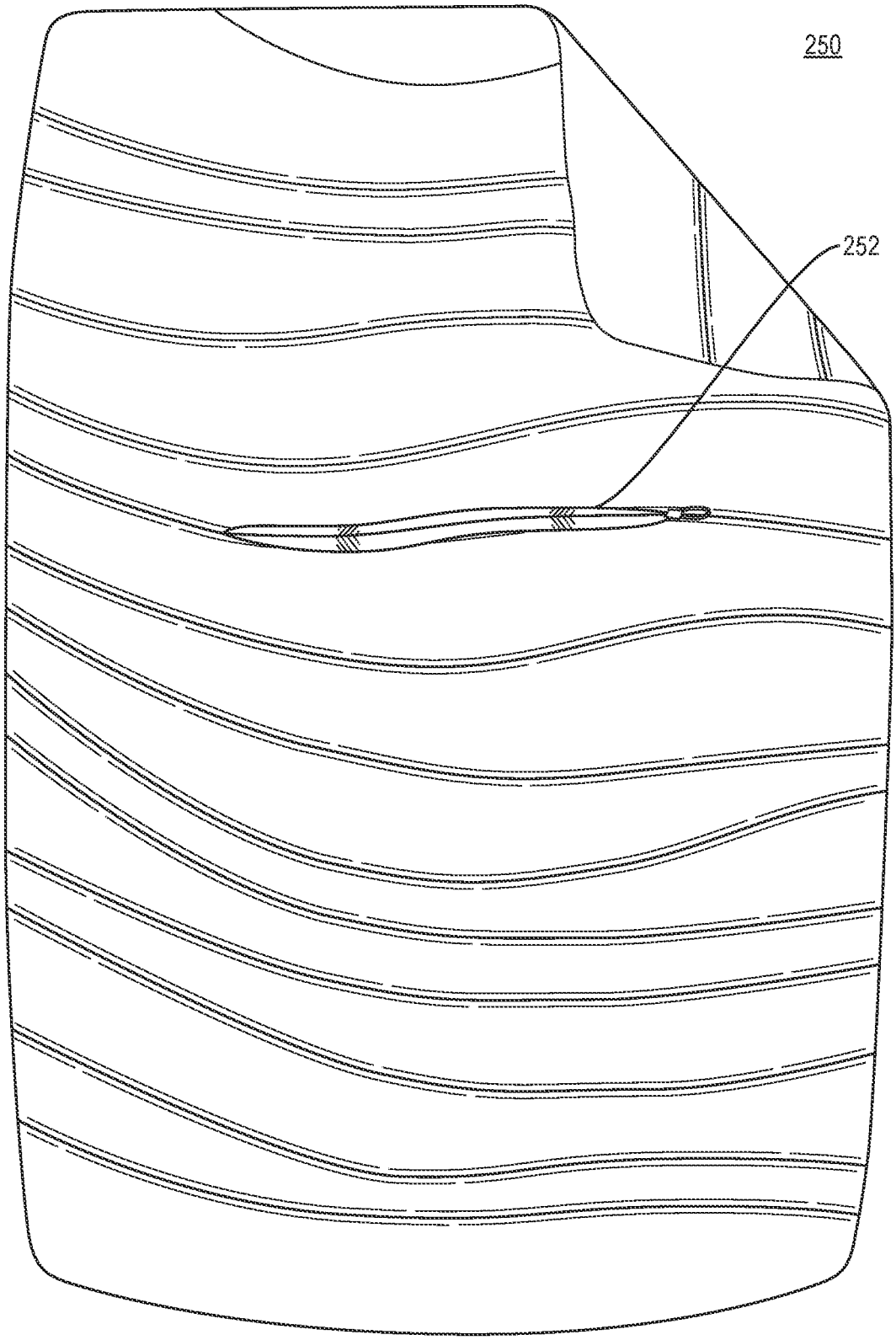
FIG. 3 is a plan view of the ventilation or temperature adjustment opening for outdoor equipment shown in an open position in a blanket according to another feature of the present invention.

The present invention is not limited to providing ventilation or temperature regulating openings in a sleeping bag but may also be utilized in other outdoor equipment such as a jacket or coat 230, FIG. 2 or a blanket, FIG. 3. In much the same way as described in connection with the embodiment covering sleeping bags, the ventilation or temperature regulating openings 232 may be provided and opened or closed to a desired extent by the user to regulate the ventilating action of the openings 232. The ventilation or temperature regulating openings 232 may be located not only in the front of the garment but also in the sleeve (not shown) and also potentially in the back of the garment (also not shown) which other locations are considered to be within the scope of the present disclosure.

In another embodiment, one or more ventilation or temperature regulating openings 252, FIG. 3 may be provided in a blanket 250. Again, although only one opening is shown is considered to be within the scope of the present invention that multiple openings may be provided in multiple regions of the blanket 250.

In yet another embodiment, the ventilation or temperature regulating openings may be formed in a personal covering device such as a sleeping bag, coat or the like by providing first and second zippers on both the inside and outside of the covering device. As shown in FIGS. 4A-4D, the present embodiment is illustrated in connection with a sleeping bag 300 shown in cross-section in these drawings. The sleeping bag or other covering device includes an outer shell fabric 302 and an inner liner fabric 304.

Between the shell fabric 302 and the liner fabric 304 is disposed a layer of insulation 306 such as down fill insulation. A down insulated covering device typically includes a number of baffles 308 which serve to separate the covering device into various cells 310. The baffles 308 serve to prevent the down insulative material from moving or shifting between the shell fabric layer 302 and the liner fabric layer 304 leaving areas of the covering device with no insulative material.

This embodiment of the present invention features an inside zipper 312 disposed in the inner liner fabric 304 and an outside zipper 314 disposed in the outer shell fabric layer 302. In one implementation of the invention, connected to one side of the outside zipper 314 and one side of the inside zipper 312 is a piece of connector fabric 316*a* which serves to keep the two portions 318, 320 of the covering device from completely separating apart when both zippers are open. In another implementation of the invention, the piece of connector fabric 316*b* is connected between both sides of the shell. It is understood that the connector fabric 316 could also be provided between both sides on the inside zipper 312.

Figure 4A:
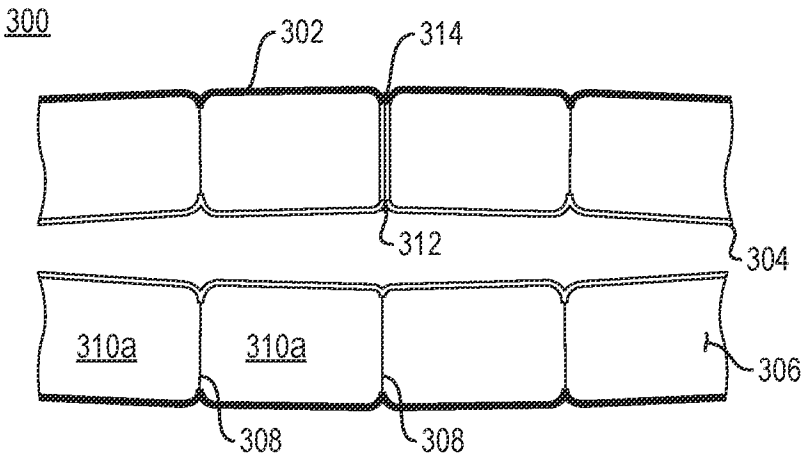
FIGS. 4A-4D illustrate a second embodiment of the invention wherein the temperature adjustment opening is formed by two zippers, one in each of the outer and the inner layer of the covering.
Figure 4B:
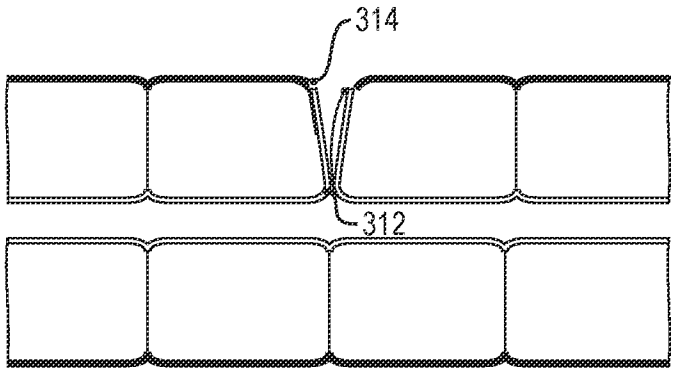
Figure 4C:
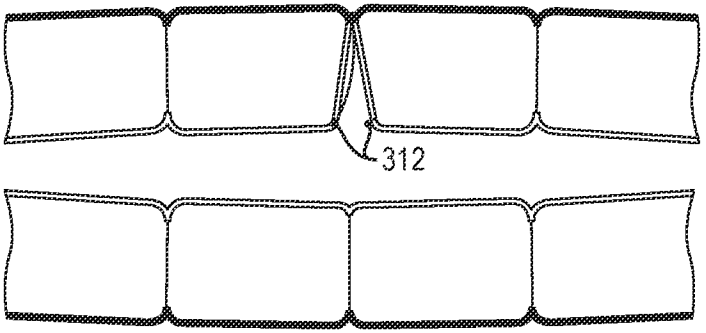
Figure 4D:
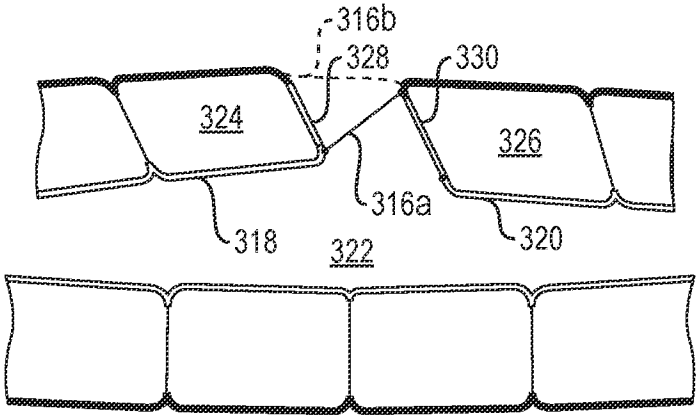

By opening only the outside zipper 314 as shown in FIG. 4B; or only the inside zipper 312 as shown in FIG. 4C; or both the inside and outside zippers as shown in FIG. 4D, the interior area 322 of the covering device, such as a sleeping bag or coat, can be vented by providing an area with no insulation while preventing bugs or other debris from entering the inside area 322 of the covering device and while simultaneously keeping the two portions of the covering device 318, 320 from completely separating and opening which is undesirable.

The piece of connector fabric 316 is a lightweight, high strength fabric such as nylon taffeta fabric or similar of the type of fabric used for liner material in a sleeping bag and also an insulated coat or jacket liner. In the preferred embodiment, the connector fabric 316 is approximately 3 inches in length.

In this embodiment, the two cells 324, 326 adjacent the inside and outside zippers each include a vertically extending downproof fabric wall portion 328, 330 that keep the down insulative material contained within the adjacent cells 324, 326 and prevent the down insulative material from escaping from the cell. In addition, the material of the vertically extending downproof fabric wall portions 328, 330 should be of a type that is abrasion resistant and not prone to snagging. An example of such a material is nylon taffeta, the same as or similar to the liner fabric layer 304.

The material which serves as a mesh baffle 308 between adjacent cells 310 that do not include a zippered opening is typically a light weight polyester or nylon mesh which limits movement of down filling between cells while allowing air and temperature exchange between adjacent cells.

Accordingly, utilizing the technique disclosed in this embodiment, the covering device such as a sleeping bag, blanket or coat can be easily vented by the user my opening either the inside zipper, the outside zipper or both, to accommodate changing temperature conditions and needs for the amount of the venting or lack thereof in the insulative material forming the covering device.

In another embodiment of the present invention, a technique for parting and sideways compressing down or other similar insulative material in a cell of a covering device is disclosed. In this embodiment, an air bladder is inflated within a cell full of insulative material, such as down, and compresses the insulative material to the sides leaving an area with no insulative material. The area or size of the air bladder and thus the amount of insulative material compressed out of the way can be adjusted by inflating the air bladder with more or less air.

Figure 5B:
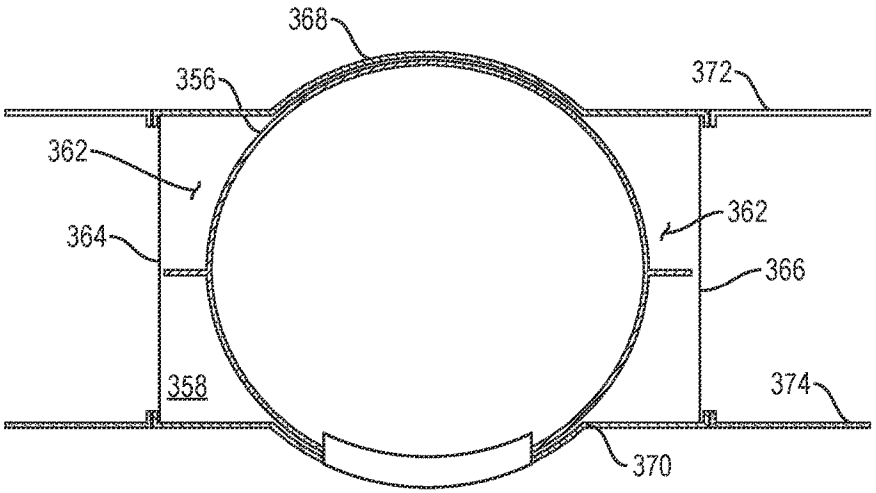
FIGS. 5A-5E illustrate another embodiment of the invention showing how the temperature adjustment opening may be provided using an inflatable air bladder to part the insulative material in a covering.
Figure 5C:
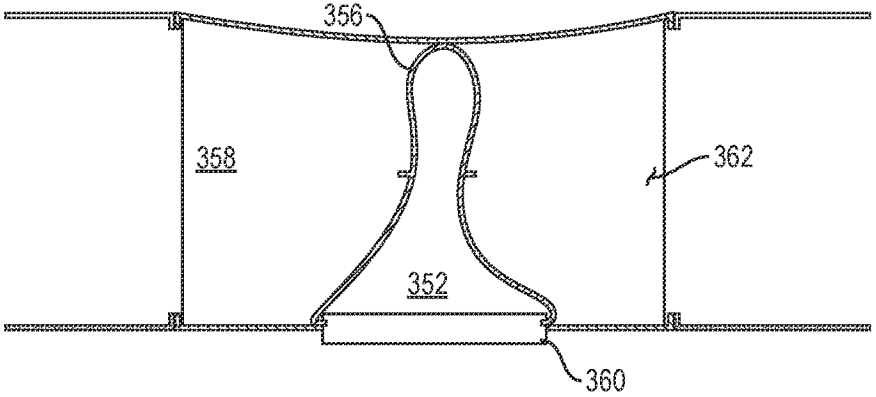
Figure 5A:
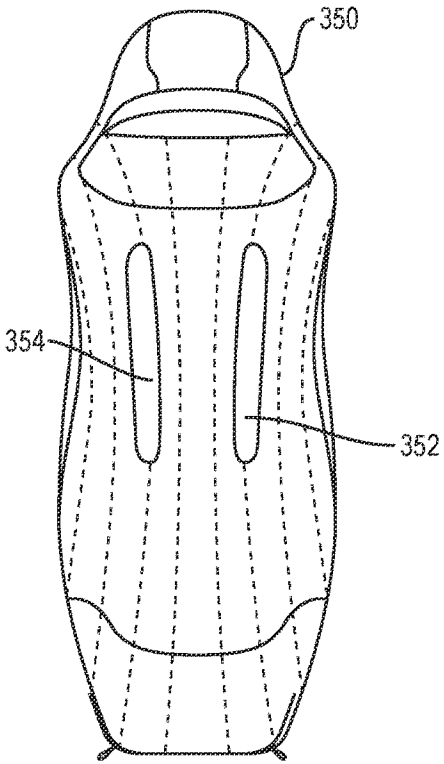

As shown in FIG. 5A, the covering device such as, for illustrative purposes only, sleeping bag 350, may include one or more air bladders 352, 354 which serve to compress the insulative material from within the "cell" in which the air bladder is located. As shown in FIG. 5C, one air bladder, such as air bladder 352 is shown in a deflated state and is formed by a TPU film 356 located within a cell such as cell 358. A standard air valve 360 is provided in the bladder 352 and allows the bladder 352 to be inflated and deflated. In the deflated state, the down or other similar insulation 362 generally completely occupies the cell 358.

In an inflated state as shown in FIG. 5B, the air bladder 356, pushes the insulation material 362 against the mesh side the baffles 364, 366 of the cell 358 thus providing no insulation material in the area of the bladder and essentially allowing heat from inside of the covering device, such as a sleeping bag, to travel through the air in the bladder, to the outside.

In this embodiment, the cell 358 in which the air bladder 356 is disposed includes top (outer) and bottom (inner) stretch fabric layers 368, 370 which provide the needed flexibility in the exterior and interior of the covering device to allow the air bladder to expand (FIG. 5B) when inflated and contract when deflated (FIG. 5C). The stretch fabric layers 368 and 370 are designed and selected to attach by stitching or welding or the like to the covering device shell fabric 372 and liner fabric 374 respectively. In the preferred embodiment, the stretch fabric layers 368 and 370 are made from polyester fabric laminated on one side with a TPU film.

Figure 5E:
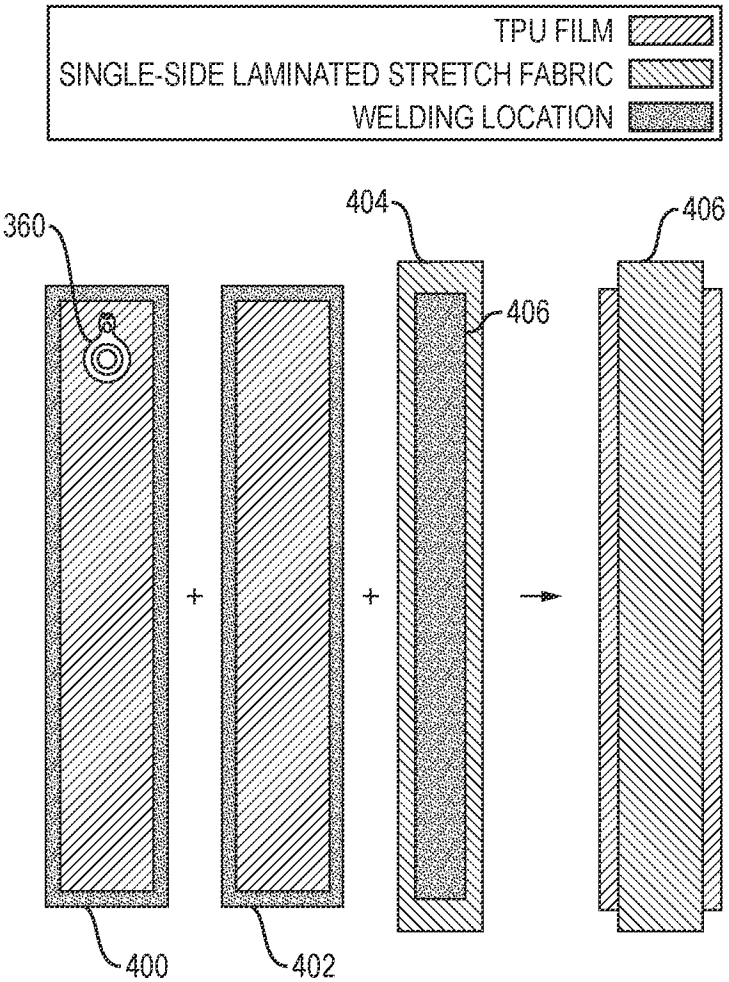
Figure 5D:
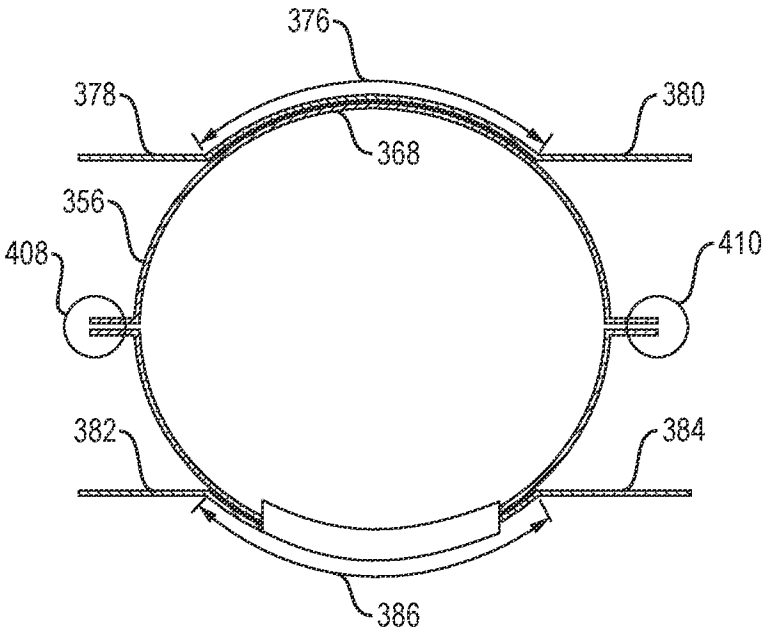

As shown in FIG. 5D, the TPU film of bladder 356 is stretch welded to the stretch fabric 368 in the area shown by arrows 376 while sewing flanges 378 and 380 are provided to allow for sewing the top stretch fabric to the adjacent non-stretch shell fabric of the covering device. In a similar manner, the lower portion of the TPU film of bladder 356 is stretch welded to the stretch fabric 370 along the bottom of the bladder while sewing flanges 382 and 384 are provided to allow the lower stretch bladder portion 370 to be attached to the inner or liner fabric 374.

As shown in FIG. 5E, element 400 shows a TPU film portion including a fill valve 360 illustrating the welding location 401 along the peripheral external border of the TPU film. The same is true in TPU film 402 without the fill valve. Layer 404 shows the stretch fabric material 368, 370 as well as the central region 406 illustrating where the stretch fabric material is bonded to the TPU film as shown by arrows 376, 386. Lastly, image subassembly 406 illustrates the stretch fabric where bonded to the TPU layer and illustrating how the TPU layer extends beyond the width of the stretch fabric for providing a TPU film weld region 408, 410 as shown in FIG. 5D.

Figure 6:
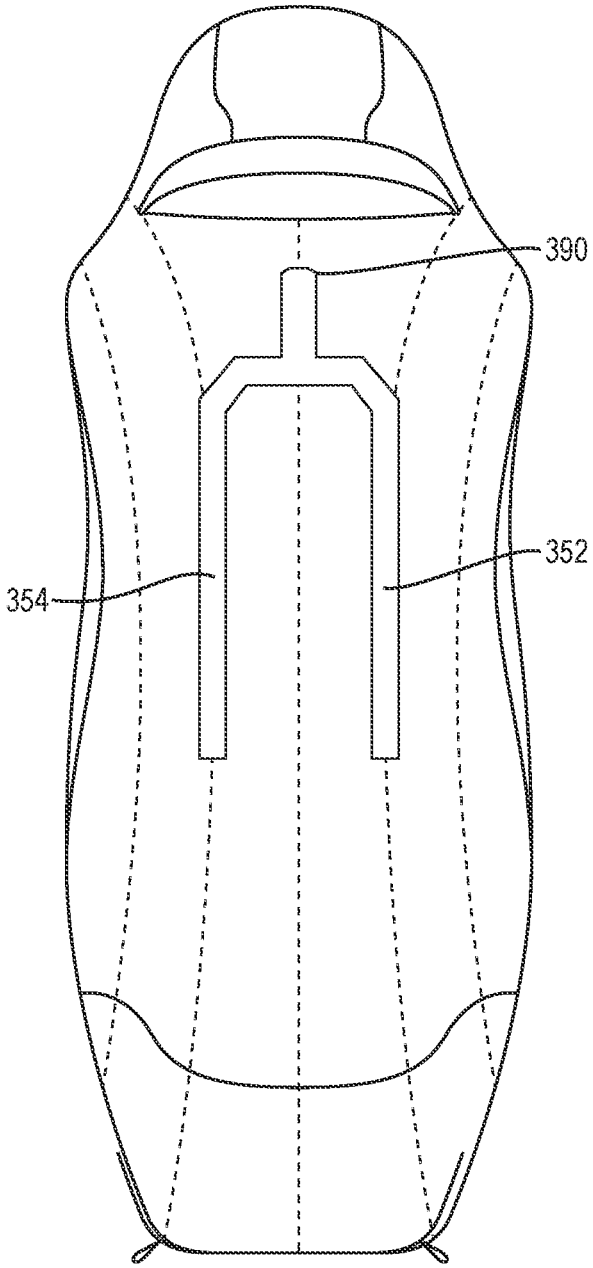
FIG. 6 illustrates how two inflatable air bladders may be joined to one common air fill and exhaust valve in relation to the embodiment described in connection with FIGS. 5A-5E.

The present invention contemplates that one or more bladder assemblies 352, 354, FIG. 6, may be provided in the covering device such as a sleeping bag and wherein the air bladders are coupled together to a single inflation/deflation valve location 390.

Accordingly, this embodiment of the present invention provides a device and method by which to compress down or other insulative material in a covering device allowing warmth from the inside of the covering device to escape to the outside of the covering device through the air bladder were no insulation is present.

As stated above, the present invention is not intended to be limited to a device or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention, which is not to be limited except by the allowed claims and their legal equivalents.

The invention claimed is:

1. A covering for providing warmth to a user, said covering including one or more temperature adjustment openings and comprising:

a covering configured to provide warmth to a user, said covering constructed of an outer layer of non-insulative material, an inner layer of non-insulative material and an insulative material disposed between the outer and inner layers, said covering further including a plurality of baffles coupled between said outer layer and said inner layer, said plurality of baffles configured for forming a plurality of covering cells, wherein a first and a second of said plurality of baffles are configured for forming a single covering cell, each of said plurality of covering cells including said insulative material disposed between said outer and inner layers and said first and second baffles; and at least a first temperature adjustment opening forming device, disposed between a first covering cell and a second covering cell, said at least a first temperature adjustment opening forming device configured for forming at least a first temperature adjustment opening having no insulative material and disposed between said outer and inner layers and between said first and second covering cells, allowing body heat from proximate said inner layer of said covering to pass through said outer layer of said covering without passing through said insulative material;

wherein said at least a first temperature adjustment opening forming device is an inflatable air bladder.

2. The covering of claim 1, wherein said outer layer and said inner layer adjacent to said inflatable air bladder are made from a stretchable material and coupled to said inflatable air bladder.

3. A covering for providing warmth to a user, said covering including one or more temperature adjustment openings and comprising:

a covering configured to provide warmth to a user, said covering constructed of an outer layer of non-insulative material, an inner layer of non-insulative material and an insulative material disposed between the outer and inner layers, said covering further including a plurality of baffles coupled between said outer layer and said inner layer, said plurality of baffles configured for forming a plurality of covering cells, wherein a first and a second of said plurality of baffles are configured for forming a single covering cell, each of said plurality of covering cells including said insulative material disposed between said outer and inner layers and said first and second baffles;

a connector fabric member coupled in one of multiple configurations consisting of proximate a first end to said outer layer and proximate a second end to said inner layer, proximate a first end to said outer layer and proximate a second end to said outer layer, and proximate a first end to said inner layer and proximate a second end to said inner layer, and wherein said connector fabric is configured for preventing said first and second covering cells from separating apart a distance greater than a length of said connector fabric; and at least a first temperature adjustment opening forming device, disposed between a first covering cell and a second covering cell, said at least a first temperature adjustment opening forming device configured for forming at least a first temperature adjustment opening having no insulative material and disposed between said outer and inner layers and between said first and second covering cells, allowing body heat from proximate said inner layer of said covering to pass through said outer layer of said covering without passing through said insulative material;

wherein said at least a first temperature adjustment opening is formed by an opening in the outer layer of non-insulative material, and an opening in the inner layer of non-insulative material thereby fluidically connecting an exterior environment adjacent to an exterior side of the outer layer to an interior environment adjacent an interior side of the inner layer; and wherein said at least a first temperature adjustment opening includes an outer layer fastening device, disposed in said outer layer of non-insulative material between said first and second covering cells, and an inner layer fastening device disposed in said inner layer of non-insulative material between said first and second covering cells, wherein said outer and said inner layer fastening devices are configured for independently creating an opening in one or both said outer and inner layers respectively;

wherein said outer layer fastening device disposed in said outer layer of non-insulative material between first and second covering cells includes a fastening mechanism coupled to the covering device outer layer of non-insulative material, the fastening mechanism coupled to the covering device outer layer of non-insulative material including a first fastener element portion disposed on a first side of the at least one temperature adjustment opening and a second fastener element portion disposed on a second side of the at least one temperature adjustment opening, the fastening mechanism configured for allowing an opening in said outer layer to be configured in one of at least a fully closed position, a fully open position, and a partially open position, and wherein said inner layer fastening device disposed in said inner layer of non-insulative material between first and second covering cells includes a fastening mechanism coupled to the covering device inner layer of non-insulative material, the fastening mechanism including a first fastener element portion disposed on a first side of the at least one temperature adjustment opening in said inner layer and a second fastener element portion disposed on a second side of the at least one temperature adjustment opening in said inner layer, the fastening mechanism in said inner layer configured for allowing the an opening in said inner layer to be configured in one of at least a fully closed position, a fully open position, and a partially open position; and wherein said fastening mechanism coupled to the covering outer layer of non-insulative material is a zipper device, configured for being selectively opened, partially opened, partially closed, or closed, and wherein said fastening mechanism coupled to the covering inner layer of non-insulative material is a zipper device, configured for being selectively opened, partially opened, partially closed, or closed.

4. The covering of claim 3 wherein said insulative material is down and wherein said baffles in said first and second covering cells at least in said area of the at least a first temperature opening are constructed of a material configured for preventing down from passing through said baffle.

5. The covering of claim 3, wherein said covering is selected from the group of coverings consisting of a jacket, a sleeping bag, a blanket and a hat.

6. The covering of claim 3, wherein said opening in the outer layer of non-insulative material is formed by first and second opening side portions and wherein said opening in said inner layer of said non-insulative material is formed by first and second opening side portions, wherein said first opening side portion in said outer layer is disposed in generally a same vertical plane as said first opening side portion in said inner layer, and wherein said second opening side portion in said outer layer is disposed in generally a same vertical plane as said second opening side portion in said inner layer, and wherein said connector fabric first end is coupled to said first opening side portion in said outer layer of non-insulative material and said connector fabric second end is coupled to said second opening side portion in said inner layer of said non-insulative material.

7. The covering of claim 3, wherein the covering includes two temperature adjustment openings.

8. The covering of claim 3, wherein the fastening mechanism is selected from the group of fastening mechanisms consisting of a zipper, one or more hook and loop fasteners, a plurality of buttons and corresponding button holes and a plurality of snap fasteners.

9. The covering of claim 3, wherein the insulative material is selected from the group of insulative materials consisting of down fill, polyester fill, natural insulative material and synthetic insulative material.

10. The covering of claim 3, wherein the covering is a sleeping bag.

11. The covering of claim 10, wherein the at least one temperature adjustment opening is located in a middle region of the sleeping bag.

12. The covering of claim 11, wherein the at least one temperature adjustment opening begins in a lower region of the sleeping bag and extends to proximate an upper region.

13. A covering for providing warmth to a user, said covering including one or more temperature adjustment openings and comprising:

a covering configured to provide warmth to a user, said covering constructed of an outer layer of non-insulative material, an inner layer of non-insulative material and an insulative material disposed between the outer and inner layers, said covering further including a plurality of baffles coupled between said outer layer and said inner layer, said plurality of baffles configured for forming a plurality of covering cells, wherein a first and a second of said plurality of baffles are configured for forming a single covering cell, each of said plurality of covering cells including said insulative material disposed between said outer and inner layers and said first and second baffles; and at least a first temperature adjustment opening forming device, disposed between a first covering cell and a second covering cell, said at least a first temperature adjustment opening forming device configured for forming at least a first temperature adjustment opening having no insulative material and disposed between said outer and inner layers and between said first and second covering cells, allowing body heat from proximate said inner layer of said covering to pass through said outer layer of said covering without passing through said insulative material, and wherein said at least a first temperature adjustment opening forming device is an inflatable air bladder and wherein said outer layer and said inner layer adjacent to said inflatable air bladder are made from a stretchable material and coupled to said inflatable air bladder.

14. A covering for providing warmth to a user, said covering including one or more temperature adjustment openings and comprising:

a covering configured to provide warmth to a user, said covering constructed of an outer layer of non-insulative material, an inner layer of non-insulative material and an insulative material disposed between the outer and inner layers, said covering further including a plurality of baffles coupled between said outer layer and said inner layer, said plurality of baffles configured for forming a plurality of covering cells, wherein a first and a second of said plurality of baffles are configured for forming a single covering cell, each of said plurality of covering cells including said insulative material disposed between said outer and inner layers and said first and second baffles;

a connector fabric member coupled in one of multiple configurations consisting of proximate a first end to said outer layer and proximate a second end to said inner layer, proximate a first end to said outer layer and proximate a second end to said outer layer, and proximate a first end to said inner layer and proximate a second end to said inner layer, and wherein said connector fabric is configured for preventing said first and second covering cells from separating apart a distance greater than a length of said connector fabric; and at least a first temperature adjustment opening forming device, disposed between a first covering cell and a second covering cell, said at least a first temperature adjustment opening forming device configured for forming at least a first temperature adjustment opening having no insulative material and disposed between said outer and inner layers and between said first and second covering cells, allowing body heat from proximate said inner layer of said covering to pass through said outer layer of said covering without passing through said insulative material;

wherein said at least a first temperature adjustment opening is formed by an opening in the outer layer of non-insulative material and an opening in the inner layer of non-insulative material thereby fluidically connecting an exterior environment adjacent to an exterior side of the outer layer to an interior environment adjacent an interior side of the inner layer;

wherein said at least a first temperature adjustment opening includes an outer layer fastening device, disposed in said outer layer of non-insulative material between said first and second covering cells, and an inner layer fastening device disposed in said inner layer of non-insulative material between said first and second covering cells, wherein said outer and said inner layer fastening devices are configured for independently creating an opening in one or both said outer and inner layers respectively;

wherein said opening in the outer layer of non-insulative material is formed by first and second opening side portions and wherein said opening in said inner layer of said non-insulative material is formed by first and second opening side portions, wherein said first opening side portion in said outer layer is disposed in generally a same vertical plane as said first opening side portion in said inner layer, and wherein said second opening side portion in said outer layer is disposed in generally a same vertical plane as said second opening side portion in said inner layer, and wherein said connector fabric first end is coupled to said first opening side portion in said outer layer of non-insulative material and said connector fabric second end is coupled to said second opening side portion in said inner layer of said non-insulative material;

wherein said outer layer fastening device disposed in said outer layer of non-insulative material between first and second covering cells includes a fastening mechanism coupled to the covering device outer layer of non-insulative material, the fastening mechanism coupled to the covering device outer layer of non-insulative material including a first fastener element portion disposed on a first side of the at least one temperature adjustment opening and a second fastener element portion disposed on a second side of the at least one temperature adjustment opening, the fastening mechanism configured for allowing an opening in said outer layer to be configured in one of at least a fully closed position, a fully open position, and a partially open position, and wherein said inner layer fastening device disposed in said inner layer of non-insulative material between first and second covering cells includes a fastening mechanism coupled to the covering device inner layer of non-insulative material, the fastening mechanism including a first fastener element portion disposed on a first side of the at least one temperature adjustment opening in said inner layer and a second fastener element portion disposed on a second side of the at least one temperature adjustment opening in said inner layer, the fastening mechanism in said inner layer configured for allowing the an opening in said inner layer to be configured in one of at least a fully closed position, a fully open position, and a partially open position; and wherein said fastening mechanism coupled to the covering outer layer of non-insulative material is a zipper device, configured for being selectively opened, partially opened, partially closed, or closed, and wherein said fastening mechanism coupled to the covering inner layer of non-insulative material is a zipper device, configured for being selectively opened, partially opened, partially closed, or closed.

* * * * *